United States Patent [19]

Link, Jr. et al.

[11] Patent Number: 4,566,558

[45] Date of Patent: Jan. 28, 1986

[54] NOISE BARRIER

[75] Inventors: Julian V. Link, Jr.; Ronald E. Cronan, both of Knoxville, Tenn.

[73] Assignee: Marine Systems, Inc., Knoxville, Tenn.

[21] Appl. No.: 703,728

[22] Filed: Feb. 21, 1985

[51] Int. Cl.[4] ..... B64F 1/26

[52] U.S. Cl. ..... 181/210; 181/290

[58] Field of Search ..... 181/210, 284, 290, 287, 181/291, 294; 52/144, 145

[56] References Cited

U.S. PATENT DOCUMENTS

| | | | |
|---|---|---|---|
| 2,140,210 | 12/1938 | Schenk | 72/18 |
| 2,350,513 | 6/1944 | Leadbetter . | |
| 3,611,653 | 4/1970 | Finn | 181/290 X |
| 3,656,576 | 4/1972 | Gubela | 181/210 |
| 4,143,495 | 3/1979 | Hiatz | 52/145 |
| 4,144,296 | 3/1979 | Dickens | 264/45.4 |
| 4,241,555 | 12/1980 | Dickens | 52/454 |
| 4,284,447 | 8/1981 | Dickens | 156/78 |
| 4,330,046 | 5/1982 | Lerner | 181/210 |
| 4,358,090 | 11/1982 | Glaesener | 52/144 X |

*Primary Examiner*—Benjamin R. Fuller

*Attorney, Agent, or Firm*—Luedeka & Neely

[57] ABSTRACT

A noise barrier for the abatement of transportation-related or industrial noise is disclosed which includes a plurality of adjoining, upright panels supported by support structure. The support structure includes a plurality of spaced-apart upright posts each positioned between two adjacent panels and which provide inwardly-facing grooves for receiving the ends of the panels. Panels are stacked and are supported in the grooves to form a barrier of a desired height. The panels have a reinforced plastic foam slab attached to and sandwiched between a plastic sheet defining a traffic face to be oriented towards the source of noise and a plastic sheet defining a residential face. Pockets filled with a sound absorption material are formed in the panels at the traffic face which is selectively perforate or imperforate to achieve the desired sound transmission loss/sound absorption capabilities.

16 Claims, 9 Drawing Figures

NOISE BARRIER

The present invention relates to a noise barrier and a noise barrier panel for use in screening off residential and other areas from sources of transportation-related or industrial noise.

In order for the Interstate Highway System to be constructed in the United States and for the construction of many modern highways throughout the world, it has been necessary for highways to be located near to and often to pass through existing residential areas. Noise from highways is bothersome to inhabitants of such areas and may result in a decrease in property values. In addition, many tracts of land close to highways which would be attractive for residential construction because of convenience to transportation, are rendered unattractive for residential use because of highway noise. In urban areas, noise from transportation sources such as highways and elevated railroads and industrial noise sources has been a perennial problem.

Various types of noise barrier systems have been developed for use in the reduction of noise emanating from transportation-related noise sources. Typical systems include wall-like structures constructed of repeating units made of concrete, wood or sheet metal. In general, known noise barriers are expensive, unattractive and are sometimes ineffective. In addition, some known barriers are difficult to erect and some require periodic maintenance such as painting.

Accordingly, it is an object of the present invention to provide a noise barrier. It is a further object of the present invention to provide a panel for use in a noise barrier. It is another object of the present invention to provide a noise barrier panel which is lightweight and which provides high transmission loss/high sound absorption capabilities. It is a further object to provide a sound barrier panel which is inexpensive, aesthetically pleasing and requires little maintenance.

These and other objects will become more fully apparent as the following description of a preferred embodiment is read in conjunction with the drawings in which.

Generally, the noise barrier according to the present invention includes a generally rectangular panel supported in an upright orientation by support structure including a pair of spaced-apart posts having inwardly-facing grooves for receiving ends of the panel. The construction is repeated for a plurality of panels with the posts being located between adjoining panels to provide a barrier of any desired length. Panels are stacked while supported in the grooves to provide a barrier of a desired height.

Generally, a panel according to the present invention includes a slab of rigid plastic foam secured to and sandwiched between a first sheet of plastic defining a traffic face and a second sheet of plastic defining a residential face. The slab of foam is reinforced with reinforcing members secured to and recessed into both major surfaces of the slab with the reinforcing members extending at least along each of the edges of the major surfaces. The panel further includes at least one recess having a perimeter spaced-apart from the reinforcing members which is formed in the slab adjacent the sheet defining the traffic face to form a chamber. The chamber so provided includes a sound absorption material.

The noise barrier is effective for decreasing transmission of transportation-related noise while being weather resistant and being capable of withstanding high windloads. The traffic face is perforated in one form of the present invention to provide a panel having a high sound absorption capability.

Figure 1:
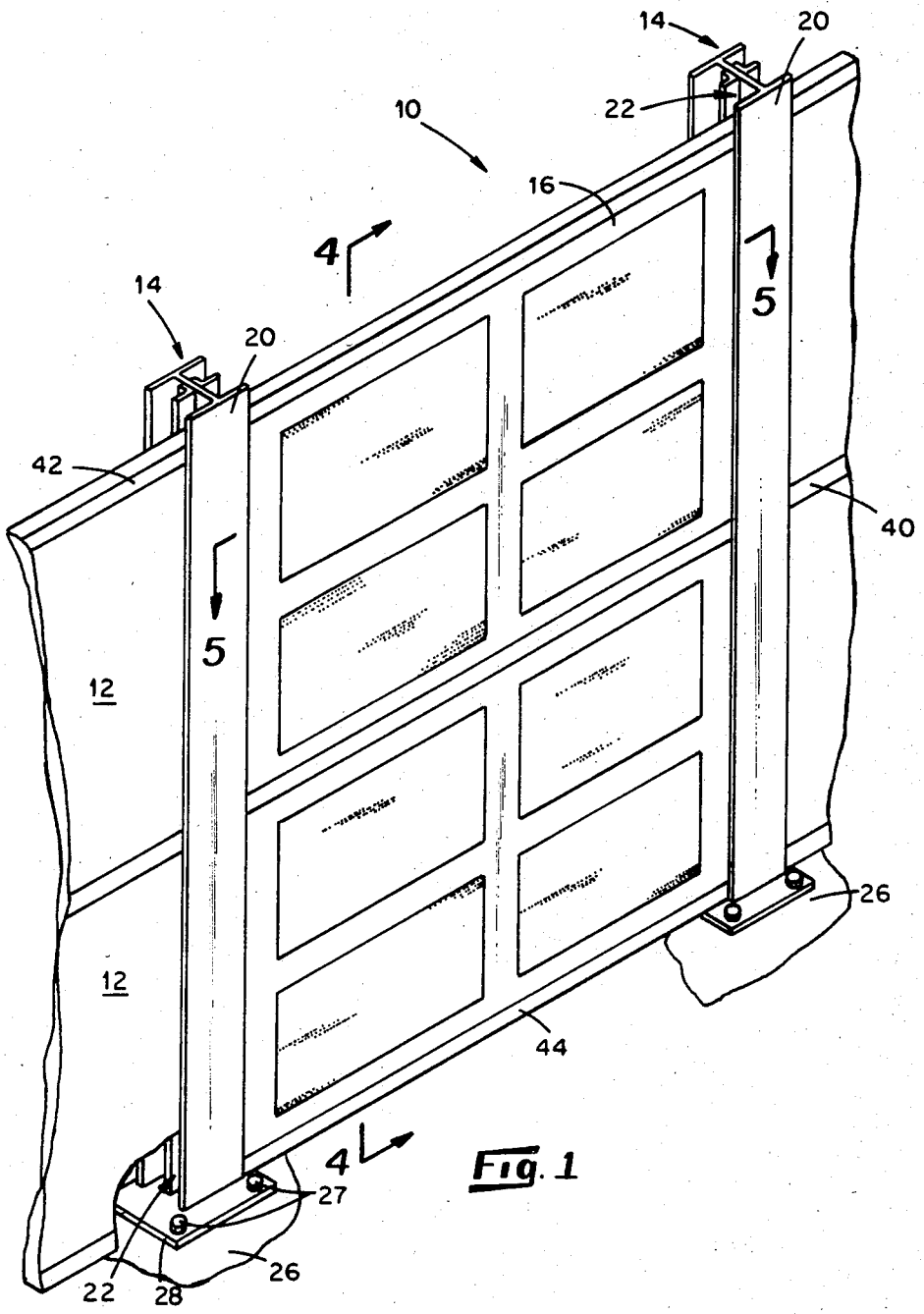
FIG. 1 is a perspective view of a portion of a noise barrier according to one form of the present invention.

Referring now to the drawings in which like reference characters designate like or corresponding parts throughout the several views, there is shown in FIG. 1 one form of the noise barrier 10 of the present invention. The noise barrier 10 includes noise barrier panels 12 and support structure 14 for supporting the panels in an upright orientation. The noise barrier panels 12 have a traffic face 16 generally facing toward the source of noise and a residential face 18 (see FIG. 7) for generally facing toward a residential or other area to be isolated from the noise.

The support structure 14 includes a plurality of spaced-apart posts 20 in a generally linear arrangement. The posts 20 provide inwardly-facing pairs of grooves 22 for receiving upright ends of the panels 12 to form the barrier 10.

Figure 2:
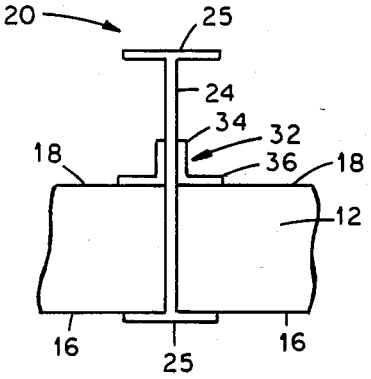
FIG. 2 is a detailed top view of support structure for the noise barrier as shown in FIG. 1.

Preferably, the posts 20 are provided by steel beams such as H-beams each having two generally parallel portions 25 and a connecting web 24 as shown most clearly in FIG. 2. The posts 20 are secured to the ground to support the panels 12 and preferably are attached to concrete footings 26 such as drilled caisson footings. As shown in FIG. 1, a preferred construction employs a foundation plate 28 welded to the bottom of the H-beam which in turn is secured to the footing 26 with fasteners such as bolts 27 embedded into the footing 26.

The posts 26 have sufficient strength to support the panels 12 and provide resistance to lateral forces applied to the barrier 10 such as by the wind. Preferably, this is accomplished by employing H-beams having a web 24 which has a width greater then the thickness of the panel 12. Web thickness is varied as is necessary depending upon the height of the barrier.

The inwardly-facing grooves 22 on the posts 20 have a width sufficient to permit insertion of the panels 12 in the grooves 22 but so that a panel 12 cannot move laterally in the groove 22 to any great extent. Preferably, the grooves support the panels along the entire upright end of each panel.

In the preferred embodiment where the web width of the H-beam providing a post 20 is substantially greater than the thickness of a panel, grooves 22 are formed as shown in FIG. 2. A retainer angle 32 is attached to the web 24 of the H-beam with an attachment strip 34 in contact with and secured to to the web 24 by welding, bolts or other such means. The angle member 32 has a retainer strip 36 which forms the groove 22 in cooperation with one of the parallel portions 25 of the H-beam. Preferably, the retainer angle 32 is attached to the web 24 so that the attachment strip 34 is not located within and does not decrease the depth of the groove 22. A retainer angle 32 is attached to the web 24 of the opposite side of the web 24 of the post 20 in a similar arrangement to enable the barrier 10 to be continued with the traffic face 16 and residential face 18 of adjoining panels in alignment.

Figure 3:
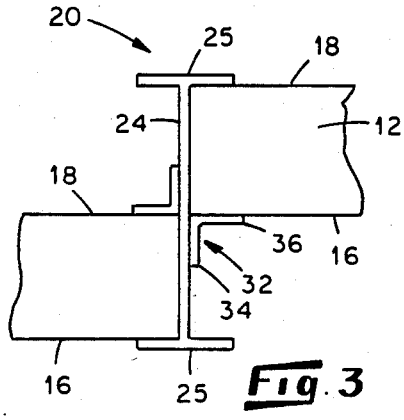
FIG. 3 is a detailed top view of an alternate configuration for the support structure for one form of the noise barrier of the present invention.

An alternate embodiment of the support structure 14 of the present invention is shown in FIG. 3 where the faces of adjoining panels are not aligned. The H-beam providing the post 20 has a web 24 having a width substantially greater than the thickness of a panel 12 and preferably about twice as great. Retainer angles 32 are arranged on opposite sides the web 24 with the retainer strips 36 cooperating with different parallel portions 25 of the H-beam on opposite sides of the beam to form the grooves 22. Again, it is preferable for the attachment strips 34 to not be located within the grooves 22. When this support structure 14 is employed, adjoining panels are out of alignment and each panel has either a forward or recessed position with respect to adjacent panels at each post 20. This structure may be repeated to provide alternating recessed and forward panels to create a "shadow-box effect".

Figure 4:
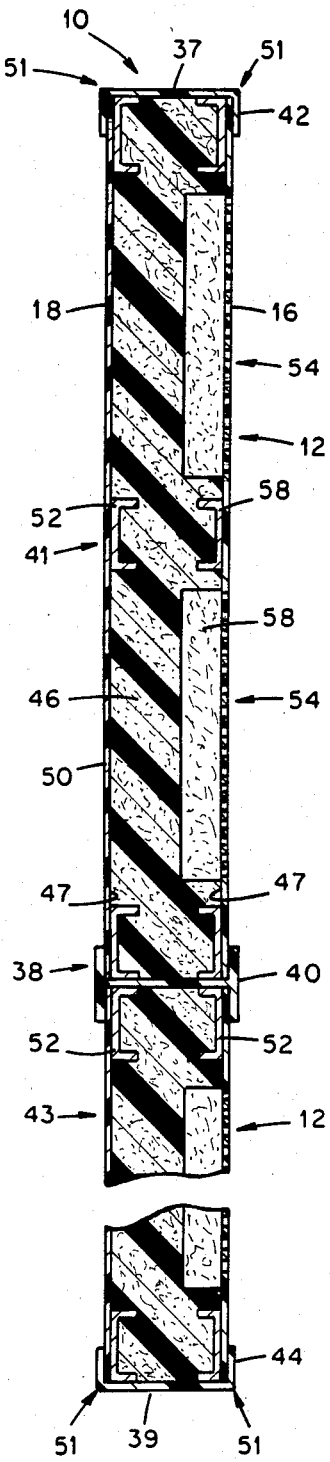
FIG. 4 is a partially broken-away cross-sectional view of the noise barrier of FIG. 1 taken along line 4—4.

The vertical height of the barrier is increased as desired by employing stacked panels 12 supported in the grooves 22 of the posts 20. Referring now to FIG. 1 and 4, two panels 12 are shown stacked in a vertical orientation. Two or more panels 12 so arranged have an upper surface 37 at an uppermost panel 41, a lower surface 39 at a lowermost panel 43 and one or more joints 38 at adjoining upper and lower surfaces of adjoining panels in the stack. A preferred construction for a barrier 10 with stacked panels 12 is shown in FIG. 4 which employs a joint member 40 having an H-shaped cross-section and provides upwardly and downwardly facing grooves for snugly receiving the panels 12 at the upwardly and downwardly facing surfaces of the panels at each joint 38. As is also shown in FIG. 4, an upper cap 42 having a channel configuration fits on the panel 12 to cover the upper surface 37 of the uppermost panel 41 in the stack. A lower cap 44 similarly covers on the lower edge 39 of the lowermost panel 43. Preferably, the joint member 40, the upper cap 42 and the lower cap 44 are made from a weather resistant plastic such as polyvinyl chloride and are secured to the panels 12 by friction fitting, by an adhesive or other such means.

Figure 6:
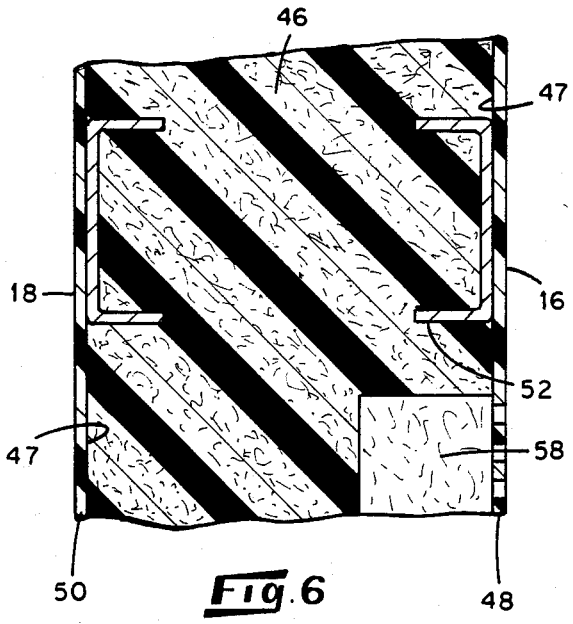
FIG. 6 is a detailed view of a portion of the cross-section of FIG. 4.
Figure 5:
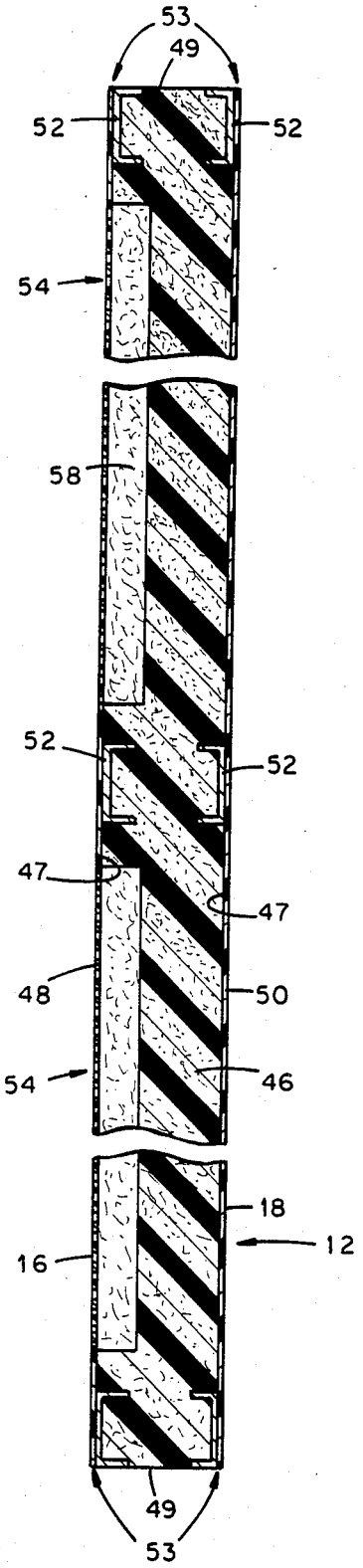
FIG. 5 is a partially broken away cross-sectional view of a noise barrier panel shown in FIG. 1 taken along line 5—5.

Referring now to FIGS. 4, 5 and 6 a panel 12 according to the present invention includes a slab of plastic foam 46 secured to and sandwiched between a first sheet of plastic 48 for defining the traffic face 16 and a second sheet of plastic 50 for defining the residential face 18. The slab 46 has two major surfaces 47 which are in contact with the first and second sheets 48 and 50, respectively, and has minor surfaces 49. Preferably, the major surfaces 47 of the slab 46 and thus the sheets 48 and 50 are generally rectangular in shape and longitudinal edges 51 and upright edges 53 are defined at the intersection of the major and minor surfaces.

The slab 46 is formed from an expanded plastic such as polystyrene or polyurethane which is sufficiently rigid to impart structural strength to the panel. The slab should have a sufficient thickness to provide strength to the panel to meet structural design loads and to satisfy accoustical design requirements. When polystyrene foam is employed having a density of about 1.5 pounds per cubic foot, a suitable slab thickness is between about 4–8 inches.

Reinforcing members 52 are secured to and are embedded into both of the major surfaces 47 of the the slab 46 and are flush with the major surfaces. The reinforcing member 52 provide additional structural rigidity to the panel 12 and are an integral part of the panel. The reinforcing members extend at least along the longitudinal edges 51 and the two upright edges 53 of both major surfaces 47. It is preferable for the reinforcing members to also extend both upwardly and across the major surfaces 47 between the reinforcing members 52 located at the edges when the size of the panel is sufficiently great to require additional reinforcement.

In a preferred embodiment, the reinforcing members are secured to and embedded into the slab 46 of rigid plastic foam as it is being formed. Alternately, the reinforcing members 52 are forced into the slab 46 and are secured with a water-resistant adhesive. Preferably, the reinforcing members are metal and are resistant to corrosion, e.g., galvanized steel.

As shown in FIGS. 4, 5 and 6 the reinforcing members 52 are preferably provided by channel members which have a central strip portion 60 and side portions 62 which extend away from the edges of the central strip portion 60 generally at right angles. Each of the reinforcing members 52 are secured to and embedded into the slab of foam 46 with the side portions 62 inserted into the interior of the slab 46 and with the central strip portion 60 flush with the major surfaces 47. At the edges 51 and 53, the side portions 62 of the reinforcing members 52 are generally flush with the minor surfaces 49 and are exposed. The side strip portions thus partially enclose and provide protection for the minor surfaces 49 of the slab 46. Suitable channel members for a 4–8 inch foam slab 46 are made of 22 gage galvanized sheet steel having a $\frac{3}{4}$ inch side portion 62 and a strip portion 60 of $3\frac{1}{2}$ inches for all reinforcing members except for the upright edge member 64. Preferably, the upright edge members 64 are similar channel members with a 4 and $\frac{1}{4}$ inch strip portion 60.

As shown in FIGS. 4, 5 and 6 recesses 54 are formed into the slab 46 adjacent the first sheet of plastic 48 defining the traffic face 16. The recesses 54 are formed by cutting the foam or by use of an appropriate mold during formation of the slab 46. It is necessary for the perimeter of the recesses 54 to be spaced-apart from the reinforcing members by a distance which leaves sufficient foam between the reinforcing members 52 and the perimeter of the recesses 54 so that the side portions 62 adjacent the perimeter of the recesses 54 are securely attached to the slab 46. It has been found that recesses 54 which are about 2 inches in depth impart good sound absorption/transmission loss properties to the panel with a minimum loss in panel strength.

The slab 46 should have a thickness which is sufficient to provide the recesses 54 without a great loss in panel strength due to the recesses. Preferably, the slab 46 is at least twice as thick as the depth of the recesses 54.

The first and second sheets of plastic, 48 and 50, respectively, provide additional structural rigidity to the panel 12 and protect the major surfaces 47 of the foam slab 46 from impact damage and from the elements. Preferably, the sheets are fiberglass-reinforced plastic sheets having a thickness which is sufficient to provide the strength without adding excess weight to the panel. A suitable thickness is, for example, 0.06 inches. Preferably, the exposed surfaces of the plastic sheets 48 and 50 have a non-glare finish.

The second sheet 50 defining the residential face 18 is preferably attached to the slab 46 by being integrally molded to the slab 46 when the slab 46 is formed. The first sheet 48 defining the traffic face 16 is attached to the major surface 47 of the slab 46 with a water-resistant adhesive.

The recess 54 in the slab 46 covered by the first sheet 48 provides a sound absorption chamber at the traffic face 16 of the panel 12. A sound absorption material 58 is contained within the chamber. The sound absorption material 58 is a lightweight material capable of absorbing sound at a frequency created by vehicular traffic or other transportation-related or industrial noise sources. Suitable materials are mineral wool, fiberglass, pressed wood and granulated resilient materials such as rubber granulate. For example, a 2 inch layer of mineral wool having a density of about 8 lbs/ft$^3$ and having a one mil laminated aluminum foil is effective.

Figure 9:
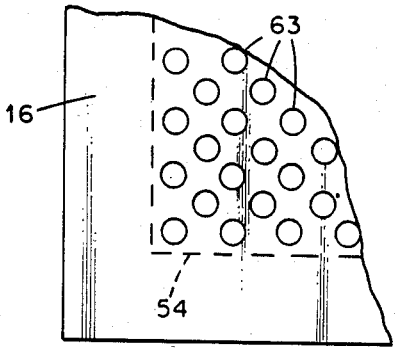
FIG. 9 is a detailed elevational view of a portion at the panel of FIG. 1 showing a preferred arrangement of apertures in the traffic face.

In FIGS. 1 and 9, panels are shown which have high sound absorption capabilities. Sound absorbency is increased by perforations 63 in the first sheet 48 which provide access for sound into the chamber at the traffic face 16. Preferably, the perforations 63 are localized above the recesses 54 and provide about 40% open area in the first sheet 48 at the recesses 54. The size of the perforations are selected to maximize sound absorption and to adequately contain and protect the sound absorption material. A preferred arrangement and size for the perforations employs 3/16 inch diameter bores with 9/32 inch staggered centers such as is shown generally in FIG. 9.

Figure 7:
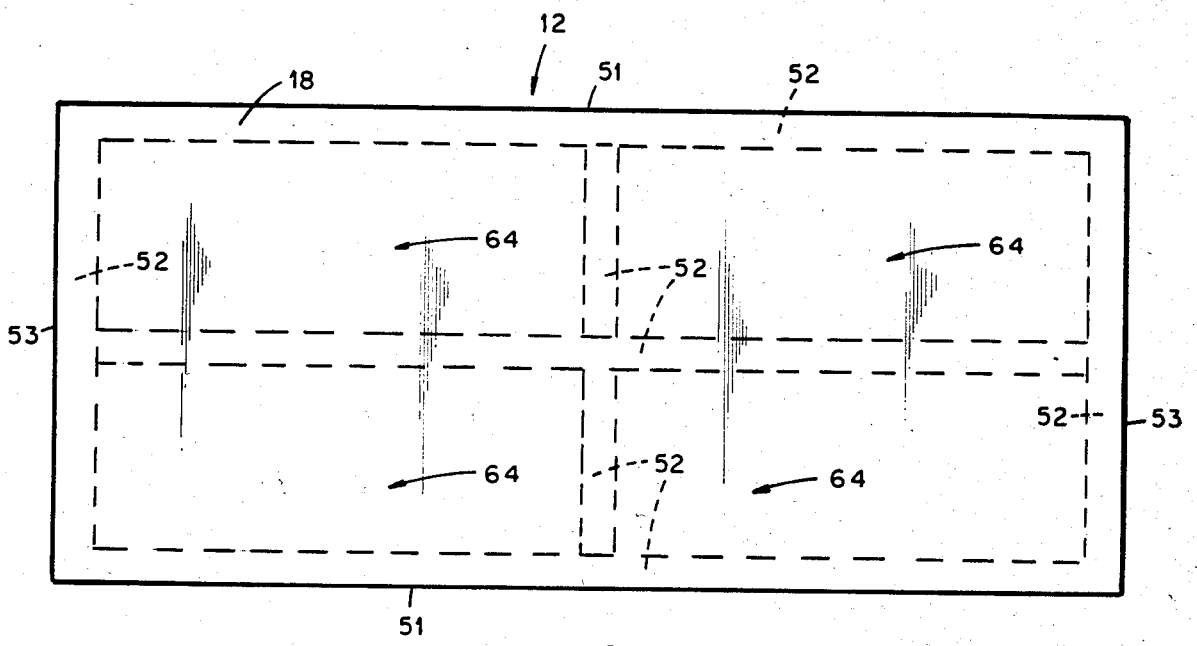
FIG. 7 is a diagrammatical elevational view of a residential face of a noise barrier panel according to the present invention.
Figure 8:
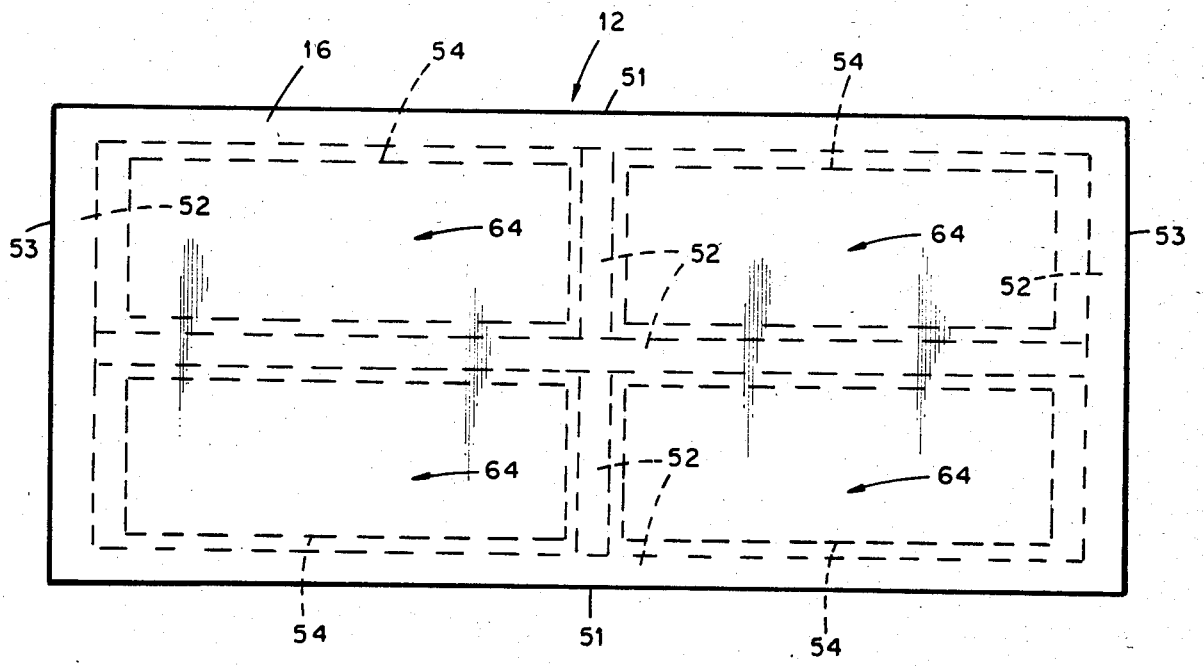
FIG. 8 is an diagrammatical elevational view of a traffic face of the panel shown in FIG. 7.

Referring now to FIGS. 7 and 8, the location of the recesses 54 and the arrangement of the reinforcing members 52 in the preferred embodiment of the present invention are shown in dotted lines. Both of the major surfaces 47 of the slab has two reinforcing members 52 along the upright edges 53 and two reinforcing members 52 along the longitudinal edges 51. In addition, a continuous longitudinal reinforcing member 52 extends between the two upright reinforcing members at the center of the panel. Each major surface 47 of the slab 46 has central upright reinforcing members 52 of approximately equal length which extend between the reinforcing members 52 along the longitudinal edges 51 and the continuous longitudinal reinforcing member.

The reinforcing members 52 divide both the traffic face 16 of the panel 12 and the residential face 18 of the preferred panel 12 into four quadrants 64 having a similar shape to the entire panel 12. As shown in FIG. 7, a recess 54 is formed into each of the quadrants 64 at the traffic face 16 of the panel 12 with the perimeter of each of the recesses being spaced-apart from the reinforcing members 52.

A panel as shown in FIGS. 7 and 8 may be constructed in a convenient size such as 4 feet high and 10 feet in length. When such a panel has a polystyrene slab 46 which is 5½ inches thick and is constructed as shown in the drawings, the panel 12 is capable of withstanding 80 mph winds as is specified for highway structures.

In use, a noise barrier 10 according to the present invention is constructed by erecting the upright posts 20 at the appropriate location along a source of transportation-related noise. Panels 12 are inserted between the posts 20 in the inwardly-facing grooves 22 of the posts 20 with the sheet 48 forming the traffic face 16 oriented towards the source of noise. The barrier 10 is easily constructed since the panels 12 may be installed by merely sliding the panels 12 from above into the grooves 22 after the posts 20 are erected. The barrier 10 can be easily disassembled by lifting the panels 12 from the grooves 22.

A panel 12 according to the present invention provides high sound transmission loss in a noise barrier 10. A panel having apertures into the sound absorbing chamber also has high sound-absorption capability. Both of these qualities are obtained in a panel of lightweight construction which is very durable and which is aesthetically pleasing. Panels according to the present invention are capable of withstanding windloads as specified for highway structures. Because the panels 12 are lightweight and are very strong, a high noise barrier can be easily constructed to increase transmission loss. High sound absorption is also achieved when panels with a perforate traffic face are employed.

Although a particular embodiment of the present invention has been described in the foregoing description, it will be understood that the invention is capable of numerous modifications without departing from the spirit of the invention as set forth in the appended claims.

What is claimed:

1. A noise barrier panel for the abatement of transportation-related noise comprising a slab of rigid plastic foam secured to and sandwiched between a first sheet of plastic defining a traffic face and a second sheet of plastic defining a residential face, said slab having two major surfaces and minor surfaces with edges at the intersection of said major and minor surfaces, a plurality of reinforcing members secured to said slab at both of said major surfaces, said reinforcing members extending along each of the edges, at least one recess formed into said slab adjacent said first sheet to form a chamber, said recess having a perimeter spaced-apart from said reinforcing members, and a sound absorption material contained in said chamber.

2. The panel of claim 1 further comprising reinforcing members secured to said slab at both of said major surfaces which extend across said major surfaces between said reinforcing members along said edges.

3. The panel of claim 2 wherein said reinforcing members are channel members which have a central strip portion and two side portions attached to and extending generally away from the edges of said strip portion, said channel members being attached to said foam slab with the side portions extending into the interior of said foam slab and with said central strip portion being flush with said major surfaces of said foam slab.

4. The panel of claim 3 wherein side portions of said channel members are exposed at said minor surfaces along said edges.

5. The panel of claim 1 further comprising perforations in said first sheet at said chamber with a size and number to provide access for sound into said chamber and for said sheet to protect and contain said sound absorption material.

6. The panel of claim 5 wherein said perforations provide about a 40% open area in said sheet at said chamber.

7. The panel of claim 1 wherein said foam slab is a slab of expanded polystyrene having a thickness between about 4–8 inches.

8. The noise barrier wall of claim 1 wherein said sound absorption material is mineral wool having a density of about 8 lbs./c.f.

9. The panel of claim 1 wherein said first and second sheets comprise fiberglass reinforced plastic sheets having a thickness of about 0.06 inches.

10. A noise barrier for the abatement of transportation related noise comprising at least two noise barrier panels, said panels each including a slab of rigid plastic foam secured to and sandwiched between a first sheet of plastic defining a traffic face and a second sheet of plastic defining a residential face, said slab having two major surfaces and minor surfaces with edges at the intersection of said major and minor surfaces, a plurality of reinforcing members secured to both of said major surfaces and extending along each of the edges, a pair of parallel and spaced-apart posts having inwardly facing grooves for receiving said panels in a stacked relationship to form a stack of said panels supported by said posts, said stack having upper and lower edges and at least one intermediate joint, said upper and lower edges being enclosed within channel members having a longitudinal groove for receiving said edges and each of said joints having a joint member having an H-shaped cross-section defining upwardly and downwardly facing grooves for receiving upwardly and downwardly facing edges of said panels at said joint.

11. The barrier of claim 10 further comprising at least one recess in said foam slab adjacent to said first sheet to form a chamber, said recess having a perimeter spaced-apart from said reinforcing members, and a sound absorption material contained in said chamber.

12. The noise barrier of claim 11, further comprising perforations in said first sheet at said chamber with a size and number to provide access for sound into said chamber and to protect and contain said sound absorption material.

13. The barrier of claim 12, wherein said perforations provide about a 40% open area in said sheet at said chamber.

14. The noise barrier of claim 10, wherein said foam slab is a slab of expanded polystyrene having a thickness of between about 4–8 inches.

15. The noise barrier of claim 11, wherein said sound absorption material is mineral wool having a density of about 8 lbs/c.f.

16. The barrier of claim 10, wherein said first and second sheets comprise fiberglass reinforced plastic sheets having a thickness of about 0.06 inches.

* * * * *